US007114545B2

(12) United States Patent
Null

(10) Patent No.: US 7,114,545 B2
(45) Date of Patent: Oct. 3, 2006

(54) MAGNETIC CATCH FOR BOTTOM RAILS OF COVERINGS FOR ARCHITECTURAL OPENINGS

(75) Inventor: Robert A. Null, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 78 days.

(21) Appl. No.: 10/977,420

(22) Filed: Oct. 29, 2004

(65) Prior Publication Data

US 2005/0126719 A1 Jun. 16, 2005

Related U.S. Application Data

(60) Provisional application No. 60/517,131, filed on Nov. 3, 2003.

(51) Int. Cl.
*E06B 9/30* (2006.01)

(52) U.S. Cl. ..... 160/178.1 R; 160/173 R; 160/349.1

(58) Field of Classification Search ..... 160/178.1 R, 160/173 R, 168.1 R, 172, 84.06, 290.1, 349.1, 160/172 R
See application file for complete search history.

(56) References Cited

U.S. PATENT DOCUMENTS 2,398,524 A * 4/1946 Foose ..... 160/178.1 R
2,428,170 A * 9/1947 McDonald ..... 160/178.1 R
2,637,382 A * 5/1953 Nelson ..... 160/178.1 R
2,864,096 A * 12/1958 Garber ..... 4/558
2,925,861 A * 2/1960 Long ..... 160/178.1 R
3,632,154 A * 1/1972 Woodrich ..... 296/24.41
4,541,469 A * 9/1985 Dressell ..... 160/178.1 R
4,594,741 A * 6/1986 Payne ..... 4/558
4,821,786 A * 4/1989 Johnston ..... 160/23.1
5,052,460 A * 10/1991 Buckingham ..... 160/178.1 R
5,067,545 A * 11/1991 Wilkins et al. ..... 160/178.1 R
5,440,289 A * 8/1995 Riordan ..... 340/550
6,098,698 A * 8/2000 King-Darr ..... 160/290.1
6,688,372 B1 * 2/2004 Nien ..... 160/172 R

* cited by examiner

*Primary Examiner*—David Purol
(74) *Attorney, Agent, or Firm*—Dorsey & Whitney LLP

(57) ABSTRACT

A magnetic catch is used on coverings for architectural openings to releasably retain the coverings in an extended position and immediately adjacent to the framework of the opening. Magnetic components are installed on the covering and the framework surrounding at least part of the architectural opening. The covering is then placed in a position such that the magnetic components on the covering and the framework are close enough to attract each other through their respective magnetic forces. The magnetic forces work to releasably hold the covering in position relative to the framework.

12 Claims, 12 Drawing Sheets

MAGNETIC CATCH FOR BOTTOM RAILS OF COVERINGS FOR ARCHITECTURAL OPENINGS

CROSS-REFERENCE TO RELATED APPLICATIONS

This application claims the benefit of U.S. provisional application No. 60/517,131 filed 3 Nov. 2003, which application is incorporated by reference in its entirety.

BACKGROUND OF THE INVENTION a. Field of the Invention

This invention relates to retractable coverings for architectural openings, and more particularly, magnetic components installed on the coverings and the framework surrounding the architectural openings to hold the coverings in position.

b. Background Art

Retractable coverings for architectural openings, such as window blind assemblies, are known in the art. When a window blind assembly is installed on an open window, wind blowing through the window can cause slats of the blind assembly to swing back and forth. Further, sometimes blind assemblies are installed on doors and will undesirably swing to and from the door when it is opened and closed.

One way to prevent the slats of the blind assembly from moving relative to the window or door is to secure the bottom slat to the framework surrounding the window or door. Many window blind assemblies currently available, however, do not provide a means for securing the bottom slat to the framework. Some blind assemblies do provide such means, but the assemblies require the user to mechanically latch and unlatch a mechanism which is time consuming and a nuisance.

It is to overcome these shortcomings in prior art coverings that the present invention was developed.

BRIEF SUMMARY OF THE INVENTION

The present invention provides a magnetic catch to automatically releasably retain a covering adjacent to an architectural opening. Typically, magnetic components are installed on the covering and the covering is mounted in an architectural framework surrounding the architectural opening. Complementary magnetic components to that installed on the covering are then secured to the framework adjacent to the magnetic components on the covering when the covering is fully extended such that the magnetic components on the covering and the framework attract each other through their respective magnetic forces. The magnetic forces thereby work to releasably hold the covering in the fully extended position.

In one aspect of the present invention, a combination of a covering for an architectural opening and a framework include in combination: a framework extending at least partially around the architectural opening, a magnetic component secured to the framework at a predetermined location, and a retractable covering adapted to extend across the opening or be retracted adjacent to one side of the opening. The covering includes a rail along one edge thereof adapted to be positioned opposite to the one side edge of the opening when the covering is extended, and the rail has a magnetic component positionable adjacent to the magnetic component on the framework such that the magnetic components will attract each other to releasably retain the rail adjacent to the magnetic component in the framework.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Retractable coverings for architectural openings are well known in the art. Various types of such coverings are described in a PCT international patent application identified with publication No. WO 03/008751 A1, which is hereby incorporated in its entirety as if fully disclosed herein. Such coverings are movable between extended and retracted positions and when they include vanes or slats, the vanes or slats are typically additionally movable between open and closed positions. As discussed in more detail below and with reference to the attached Figures, the present invention provides a combination of a retractable covering having magnetic components mounted thereon with a framework for an architectural opening in which the covering is mounted. The framework also has magnetic components mounted thereon with the various magnetic components releasably retaining the covering in an extended position. The magnetic forces therefore help prevent the covering from swinging back and forth when the covering is utilized to cover an open window on a windy day, to hold the covering in position on a swinging door when the door is opened or closed or other such uses.

Figure 2:
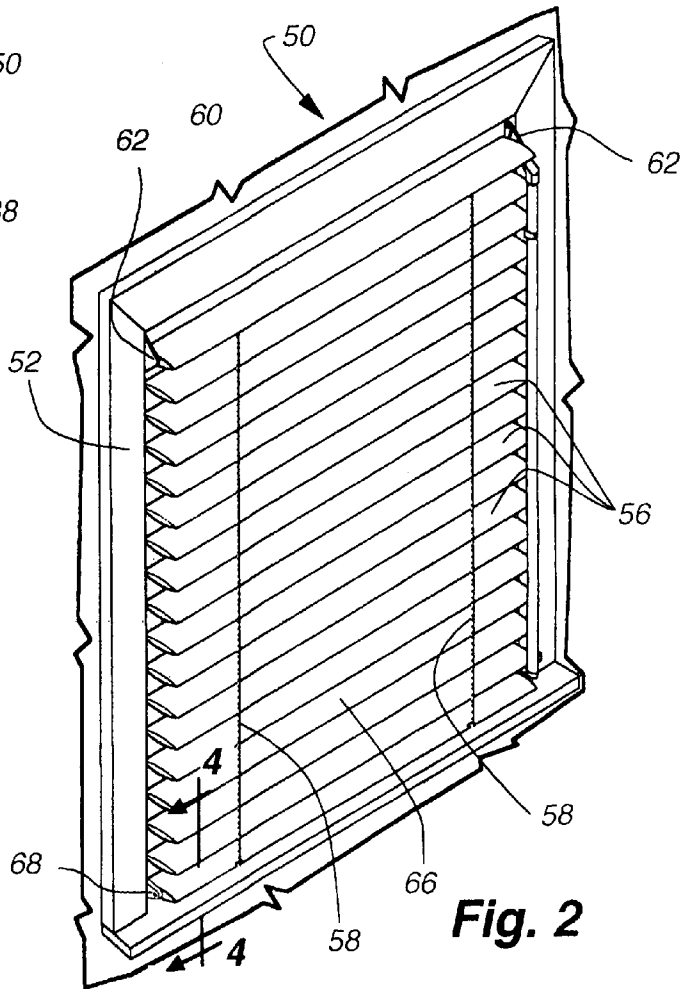
FIG. 2 is a front isometric view of the blind assembly of FIG. 1 in an extended position.
Figure 1:
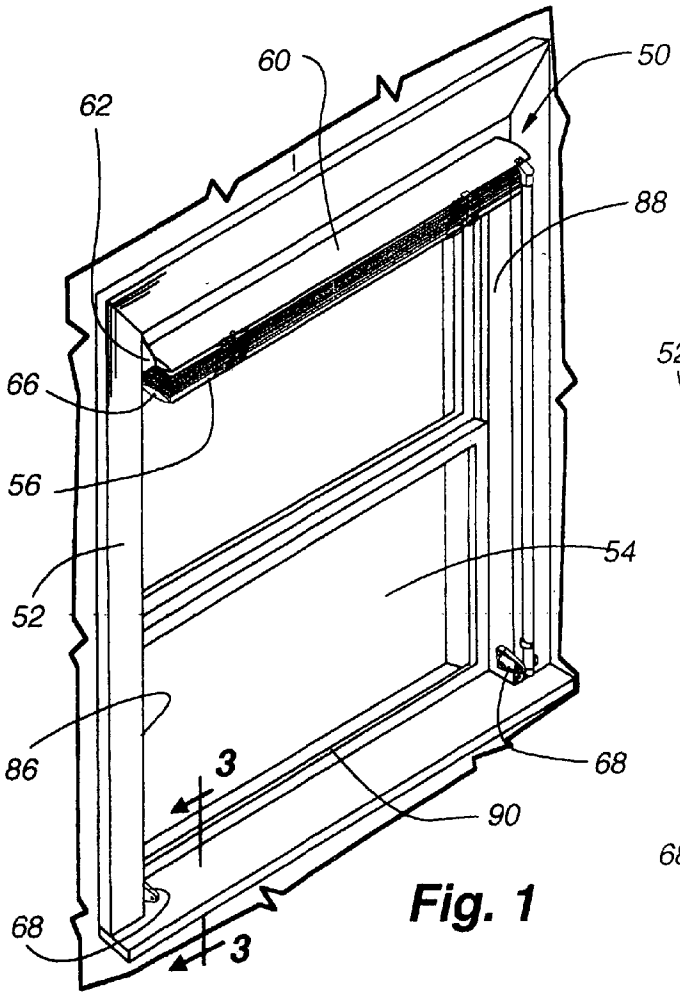
FIG. 1 is a front isometric view of a blind assembly in accordance with the present invention in a retracted position.

FIGS. 1 and 2 show the present invention as applied to a blind assembly 50 installed on a frame 52 surrounding a window 54. The blind assembly 50 includes a plurality of horizontal slats 56 supported on conventional cord ladders 58 suspended from a control system (not shown) housed inside a rigid slat-shaped head rail 60 as more fully described in the afore-noted PCT patent application. Conventional mounting brackets 62 at both ends of the head rail 60 secure the blind assembly 50 to the frame 52. The cord ladders 58 provide for pivotal movement of the horizontal slats 56 between open and closed positions. Actuation of the cord ladders also allows the blind assembly to be moved between a retracted position, as shown in FIG. 1, and an extended position, as shown in FIG. 2. When the blind assembly is in the extended position, magnetic components 64 (described in more detail below with reference to FIG. 7) installed in both ends of a bottom rail 66 of the blind assembly attract magnetic components 64 installed in catch brackets 68 connected with the frame adjacent to the bottom edge of the window. In the extended position, the bottom rail 66 of the blind assembly 50 is releasably held in position adjacent to the frame 52 by the magnetic forces created between the magnetic components. Moving the blind assembly from the extended position simply requires a user to actuate the control system and cord ladder to lift the bottom rail with enough force to overcome the magnetic force between the magnetic components.

Figure 3:
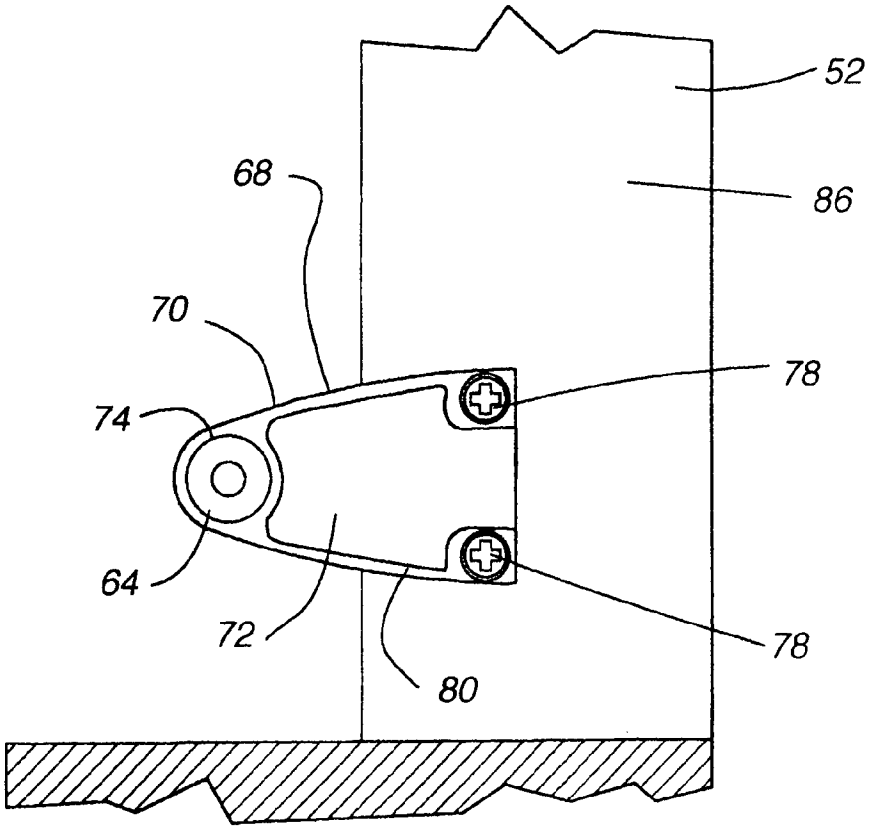
FIG. 3 is a fragmentary vertical section of a window frame taken along line 3—3 of FIG. 1, depicting one embodiment of a catch bracket mounted on a left side of the window frame adjacent to a lower edge thereof.
Figure 9:
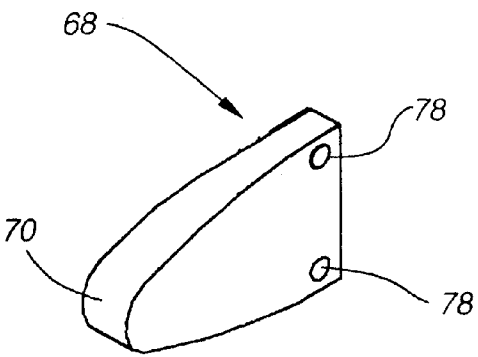
FIG. 9 is an isometric view of a second side of a catch bracket.
Figure 8:
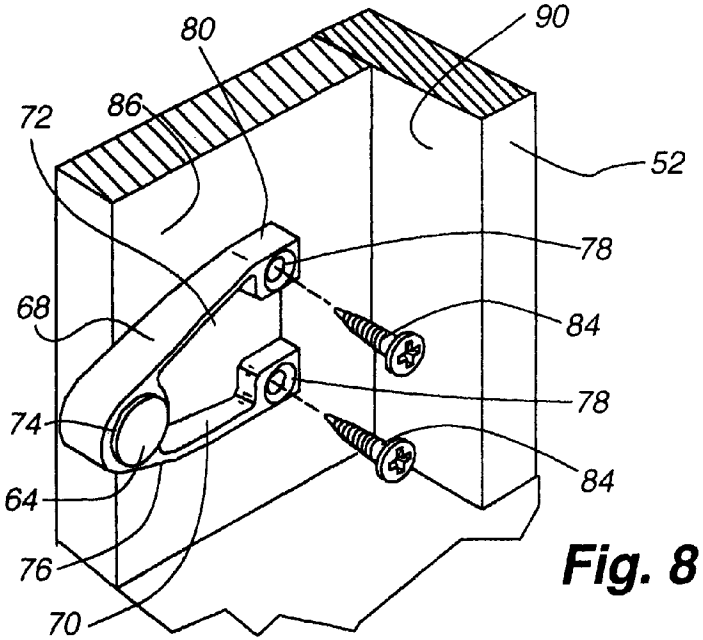
FIG. 8 is an isometric view depicting the mounting of a catch bracket to the left side of the window frame.

As illustrated in FIGS. 3 and 8, the catch bracket 68 includes a main body 70 with a first side 72 defining a circular recess 74 located in a forward region 76 for seating a magnetic component 64, and two mounting holes 78 located in a rearward region 80. As shown in FIG. 9, a second side 82 of the main body 70 is generally flat. Referring to FIGS. 3 and 8, when mounting the catch bracket 68 to the frame 52, two screws 84 are inserted into the mounting holes 78 of the catch bracket and threadedly engage the frame. As shown, the screws 84 have flat heads and the mounting holes 78 in the catch bracket are beveled to minimize any protrusion of the screw head from the catch bracket when installed. The catch bracket 68 as shown in FIGS. 3 and 8 is mounted to a left side 86 of the frame 52. As such, the first side 72 faces inwardly toward the blind assembly 50. The catch bracket 68 installed on a right side 88 of the frame 52 is identical and is inverted to face in the opposite direction.

Figure 11:
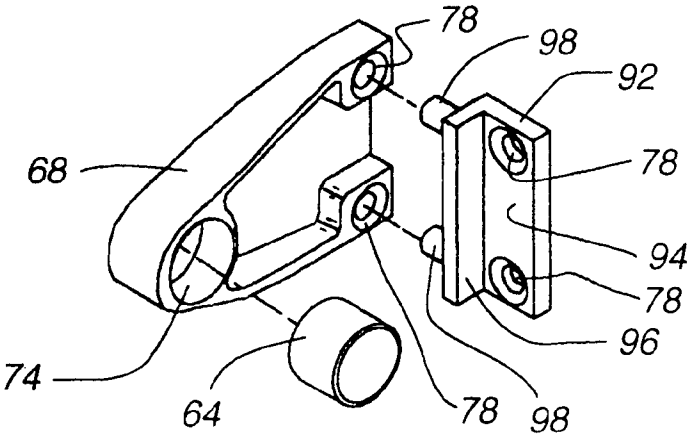
FIG. 11 is an exploded isometric view of the catch bracket depicted in FIG. 10.
Figure 12:
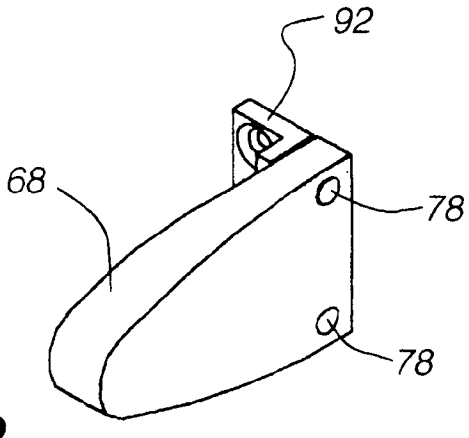
FIG. 12 is an isometric view of the second side of the catch bracket depicted in FIG. 10.
Figure 10:
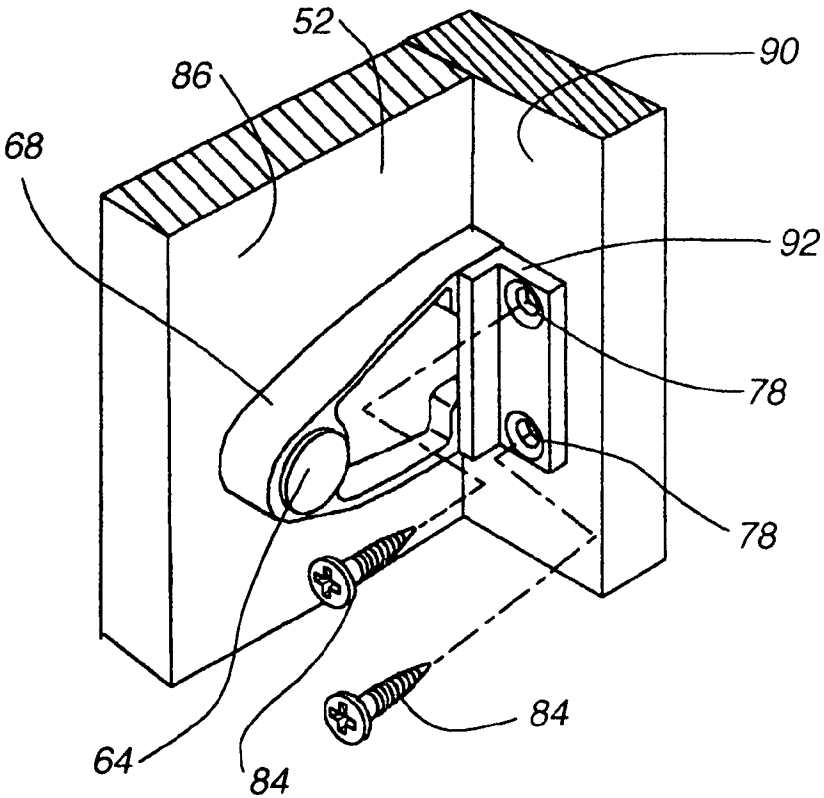
FIG. 10 is an isometric view of a catch bracket connected with a bracket extension member mounted to a rear side of the window frame.

Depending on the application, it may be desirable to mount the catch bracket on a rear side 90 of the frame 52. As shown in FIGS. 10 and 11, a bracket extension member 92 can be connected with the catch bracket 68 to effectively rotate the location of the mounting holes 78 by ninety degrees. As shown in FIG. 11, the bracket extension member 92 is L-shaped and is defined by the intersection of a first plate 94 and a second plate 96. Two mounting holes 78 are located in the first plate 94, and two posts 98 extend from the second plate 96. To connect the bracket extension member 92 with the catch bracket 68, the posts 98 on the bracket extension member are inserted into the mounting holes in the catch bracket. As shown in FIG. 10, the catch bracket 68 is mounted to the rear side 90 of the frame 52 by inserting screws 84 into the mounting holes 78 in the bracket extension member 92 to threadedly engage the rear side of the frame. FIG. 12 shows an isometric view of the second side 82 of the catch bracket when connected with the bracket extension member.

Figure 4:
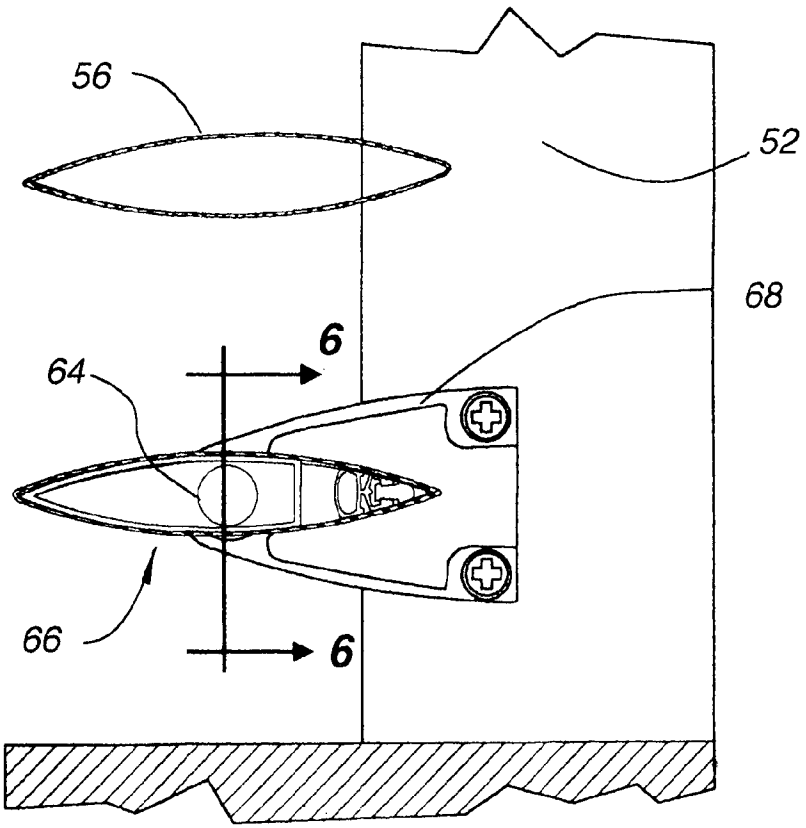
FIG. 4 is a fragmentary vertical section of the blind assembly in an extended and open position taken along line 4—4 of FIG. 2, depicting one embodiment of an end cap on a bottom rail of the blind assembly engaging the catch bracket.
Figure 4A:
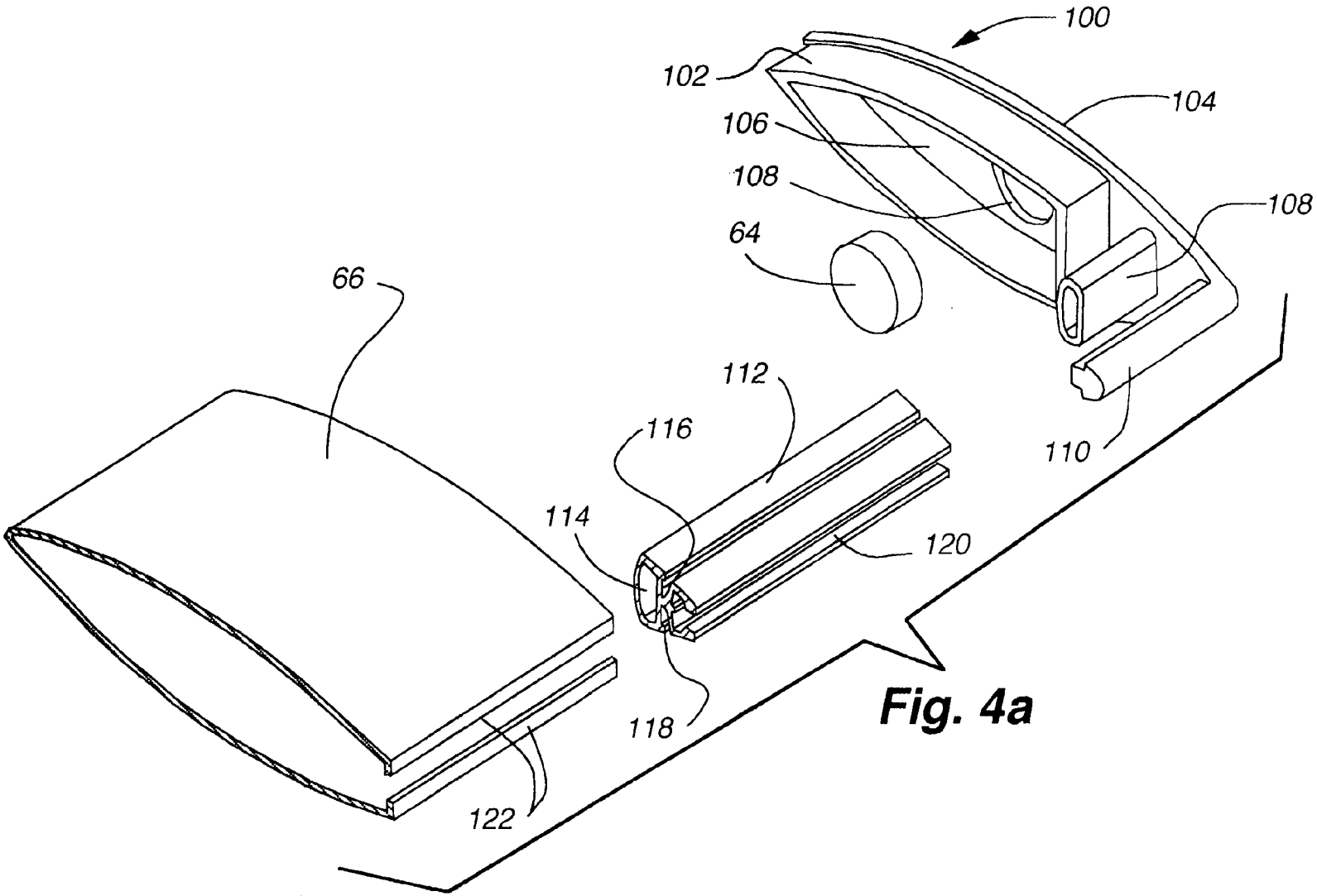
FIG. 4A is an exploded isometric view of the end cap engaging the bottom rail.
Figure 6:
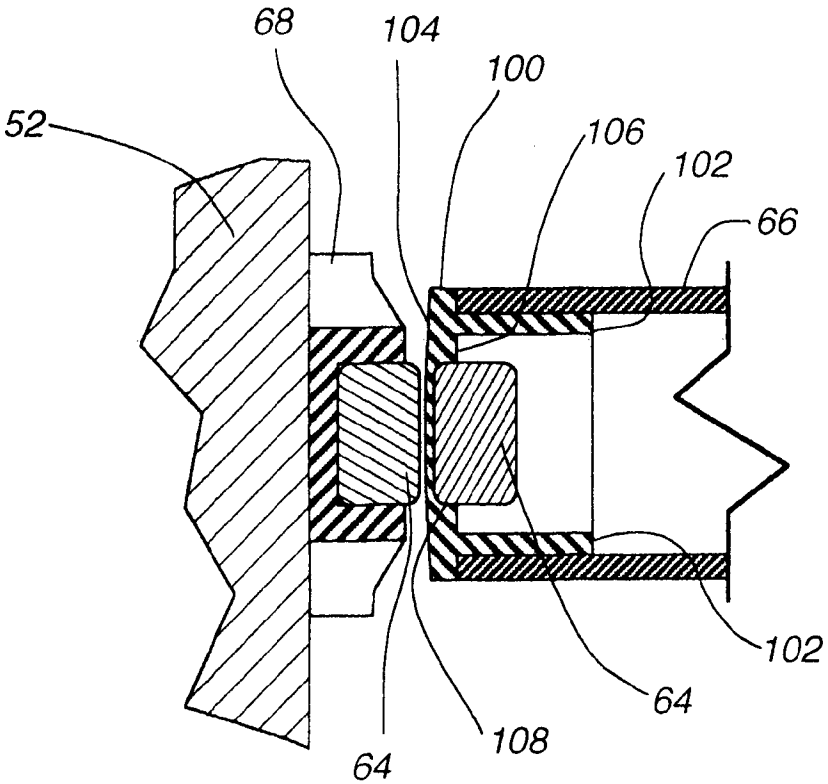
FIG. 6 is a fragmentary vertical section of the blind assembly taken along line 6—6 of FIG. 4, depicting the end cap on the bottom rail of the blind assembly magnetically interacting with the catch bracket.
Figure 7:
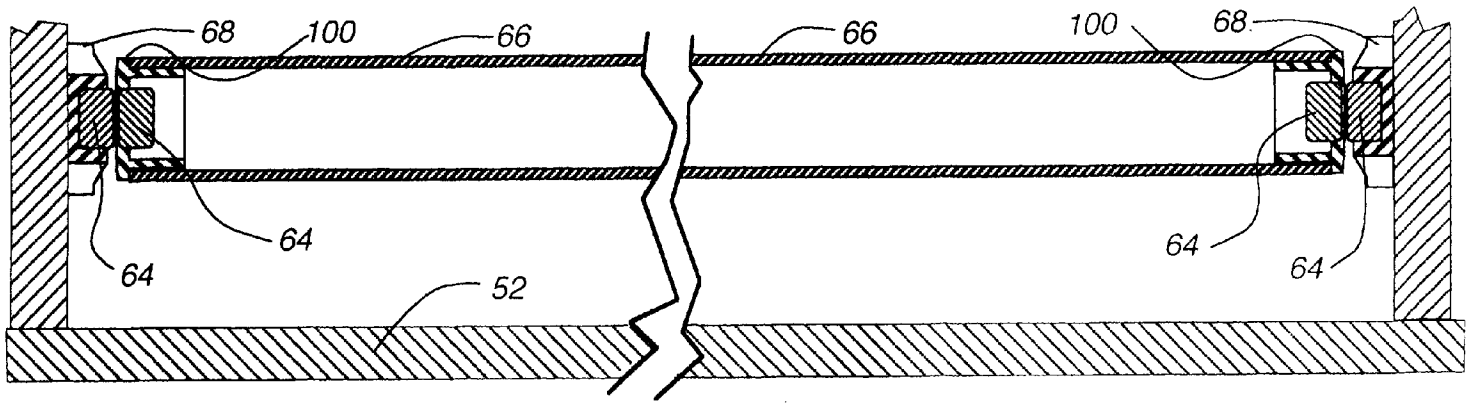
FIG. 7 is an extended view of FIG. 6 depicting the end caps at both ends of the bottom rail of the blind assembly magnetically interacting with respective catch brackets.

As previously mentioned and as shown in more detail in FIGS. 4–7 and 4A, magnetic components 64 are located in both ends of the bottom rail 66, which attract the magnetic components 64 located in the catch brackets 68 when the blind assembly 50 is in the extended position of FIG. 2. As illustrated in FIGS. 4A, 6 and 7, end caps 100 are installed in both ends of the bottom rail 66. Each end cap 100 includes an extension wall 102 adapted to be inserted into an open end of the hollow bottom rail 66. The end cap 100 also defines an end wall 104 to cover the end of the bottom rail 66, with the end wall having an inner surface 106 with a recess 108 to hold the associated magnetic component 64. As shown in FIG. 4A, a rear plug 108 and a rear edge portion 110 extend from the inner surface 106 of the end cap 100. When connecting the end cap 100 to the bottom rail 66, the end cap engages a longitudinally extending extrusion 112, which is connected with the bottom rail 66. The longitudinally extending extrusion 112 defines an extrusion tube 114, an upwardly facing top channel 116, a downwardly facing bottom channel 118, and a rear channel 120. The upwardly facing top channel 118 and the downwardly facing bottom channel 120 are adapted to receive narrow edges 122 on the bottom rail 66. The extrusion tube 114 on the longitudinally extending extrusion 112 is adapted to receive the rear plug 108 on the end cap, and the rear channel 120 is adapted to receive the rear end portion 110 of the end cap.

Figure 5:
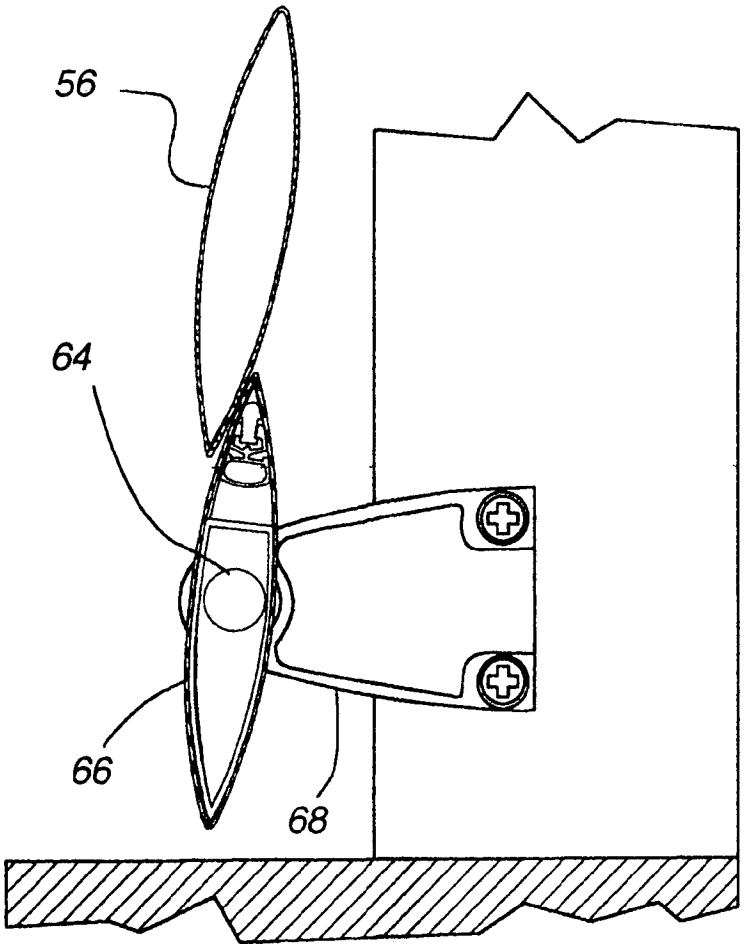
FIG. 5 is a fragmentary vertical section of the blind assembly in an extended and closed position taken along line 4—4 of FIG. 2, depicting the end cap on the bottom rail of the blind assembly magnetically interacting with the catch bracket.

When the blind assembly is in the extended position, the magnetic components housed in the end caps of the bottom rail are located adjacent to the magnetic components in the catch brackets. Equal magnetic forces pulling in opposite directions on the ends of the bottom rail hold the bottom rail in a centered position in the architectural opening that provides for no contact between the end caps and the catch brackets even though as can be seen in FIG. 6, even if the magnetic force in one direction was greater than the other so that one end of the bottom rail engaged an associated catch bracket, the blind would shift only minimally and imperceptibly. Also, as shown in FIGS. 4 and 5, the magnetic forces hold the bottom rail 66 in position, but allows the bottom rail 66 to rotate about the magnetic components 64 as the blind assembly 50 is changed from the open position to the closed position.

The magnetic components 64 used in the present invention can be of various types. For example, the magnets could be ceramic, iron or steel and could be mounted in both the bottom rail and a catch bracket such that opposite poles of the magnets were positioned adjacent to each other for the desired attraction. Magnets could be installed only in the bottom rail with magnetic components in the form of metallic objects installed in the catch brackets, or the magnets could be installed in the catch brackets with metallic objects installed in the bottom rail. The catch brackets could also be positioned at different locations on the frame to releasably secure the bottom rail of the blind assembly at a different position than a fully extended position. Further, additional magnetic components could be installed in other horizontal slats 56 to cooperate with corresponding additional catch brackets.

A second embodiment of the present invention is shown in FIGS. 13–33. In this embodiment, modifications have been made to both the catch bracket and the end cap. The second embodiment is specifically designed for use with a magnet and a metallic object as the magnetic components even though variations thereof would be known to those skilled in the art.

Figure 13:
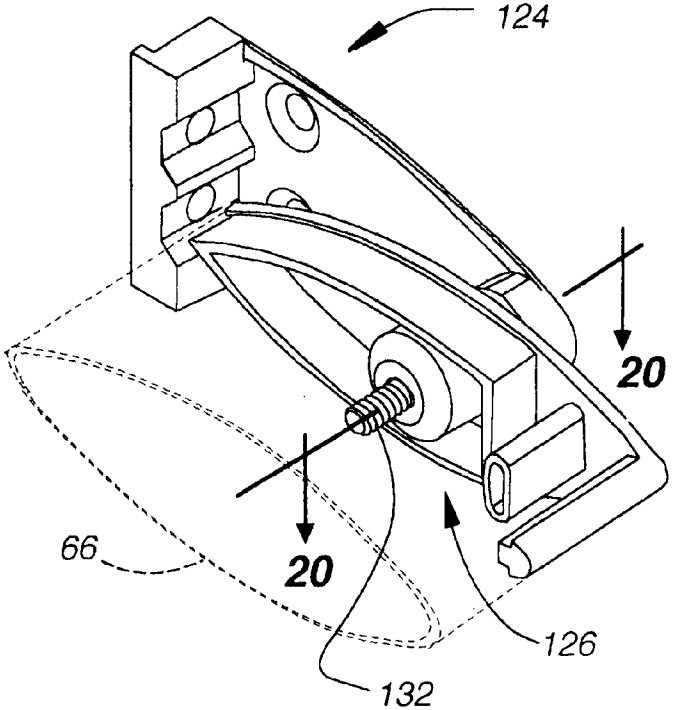
FIG. 13 is an isometric of a second embodiment of a catch bracket and end cap for a blind assembly showing a portion of a tubular bottom rail attached to the end cap in dashed lines.
Figure 14:
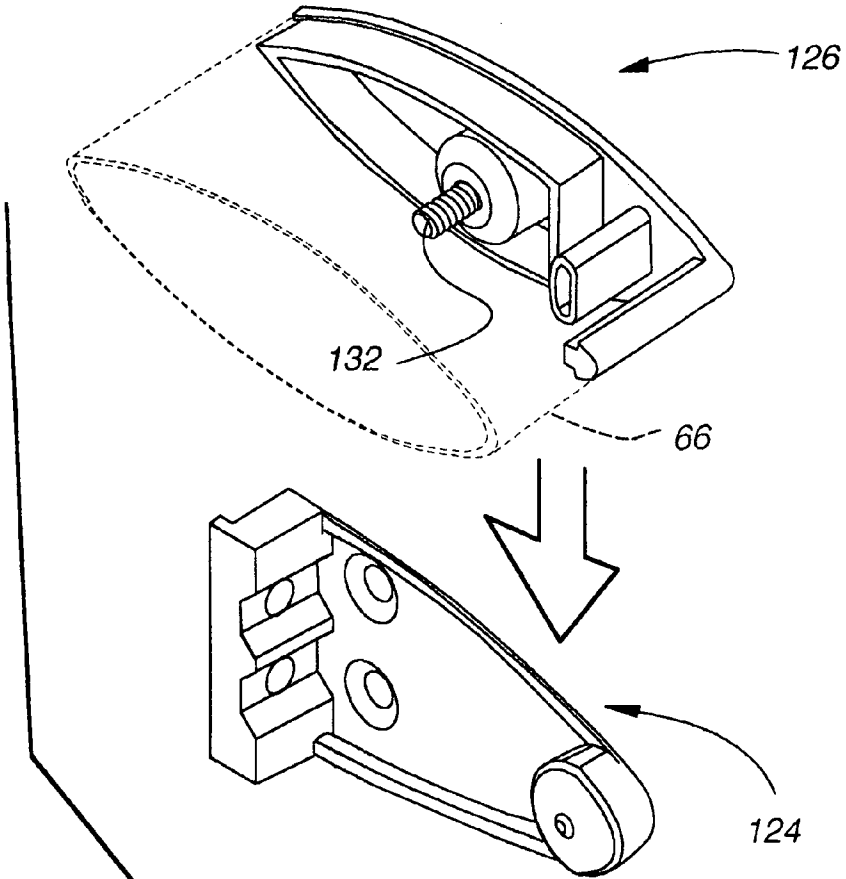
FIG. 14 is an isometric similar to FIG. 13 with the end cap and catch bracket separated.

With reference first to FIGS. 13 and 14, the catch bracket 124 and end cap 126 (shown mounted in the end of a tubular bottom rail 66 shown in dashed lines) are illustrated interconnected in FIG. 13 and separated in FIG. 14. The catch bracket is adapted to be mounted in the framework of an architectural structure and includes a magnet 130 which is adapted to attract a metallic fastener 132 anchored in the end cap 126.

Looking first at the catch bracket 124 as probably best seen in FIGS. 15–19, it will be seen to include a main body 134 having a cylindrical seat 136 on a distal end and an integral base 138 extending perpendicularly to the main body at the opposite end. The base has a pair of passages 140 therethrough for receipt of mounting fasteners (not shown) and the main body similarly has a pair of passages 142 therethrough for receipt of fasteners with either set of passages being utilized depending upon the location in which the bracket is mounted in a framework as discussed previously. The cylindrical seat 136 has diametrically opposed slots 144 formed in its outer surface adapted to releasably receive a circular closure cap 146 having diametrically opposed legs 148 with catches 150 on their distal ends adapted to be releasably received in the slots. The catches 150 on the ends of the legs are receivable in a depression 152 at the innermost end of each slot 144 but the catch is designed so that an outward force applied to the closure cap will cause the cap to be released from the cylindrical seat.

Figure 17:
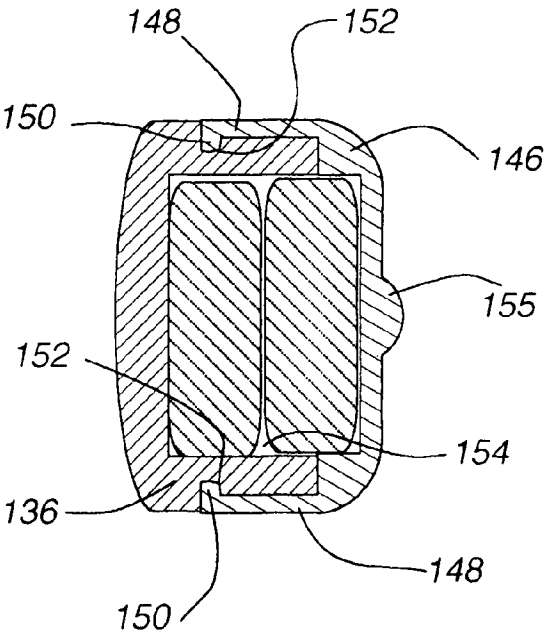
FIG. 17 is an enlarged section taken along line 17—17 of FIG. 15.
Figure 15:
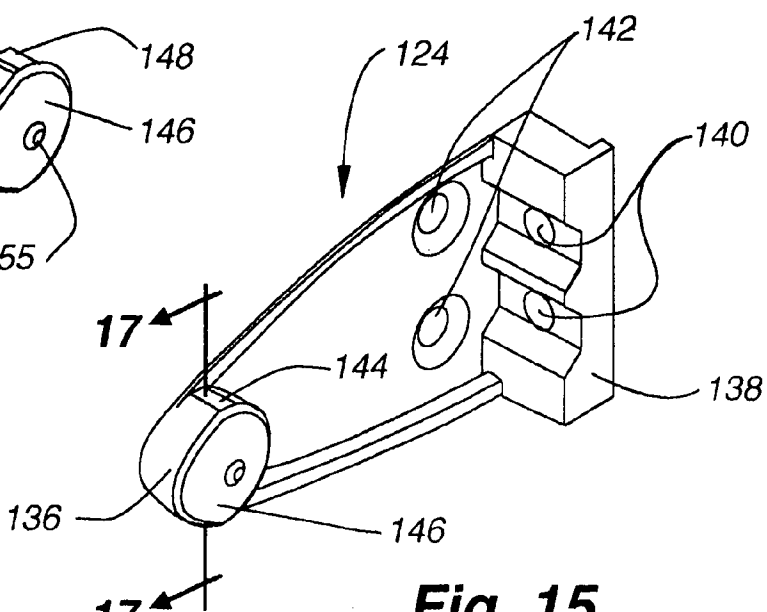
FIG. 15 is an isometric of a fully assembled catch bracket of the embodiment of FIG. 13.
Figure 16:
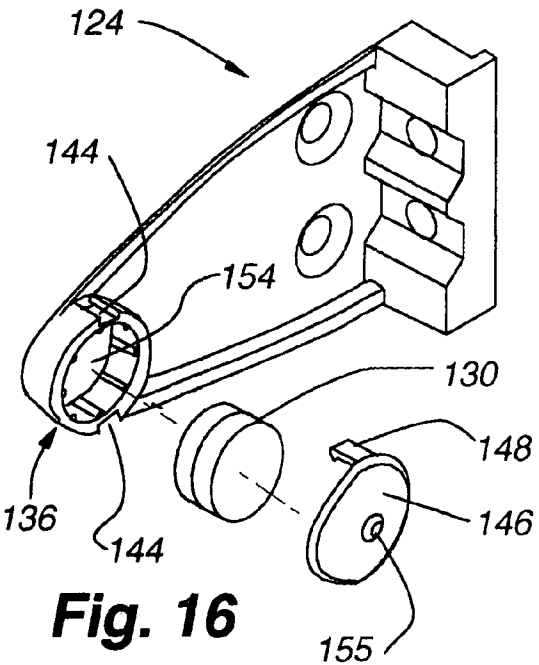
FIG. 16 is an exploded isometric of the catch bracket as shown in FIG. 15.

A cavity 154 is defined by the cylindrical seat 136 and the closure cap 146 which is adapted to receive the cylindrical magnet 130. FIG. 17 shows the magnet seated in the cavity and the closure cap snapped into position on the cylindrical seat. The closure cap also has a pimple 155 at its geometric center which projects axially away from the closure cap for a purpose to be described later. The catch bracket is preferably made of a somewhat rigid material that might flex slightly to desirably attract and removably retain the end cap 126 of the bottom rail of a covering or blind assembly as will become more clear hereafter.

Figure 19:
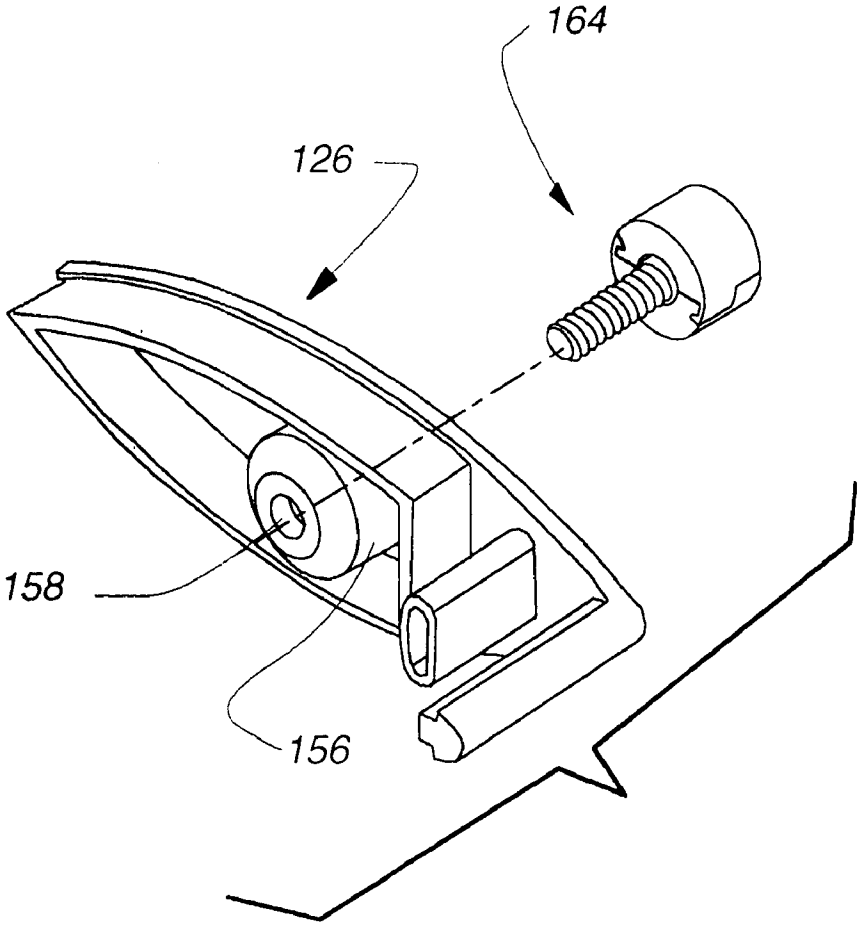
FIG. 19 is an exploded isometric similar to FIG. 18.
Figure 18:
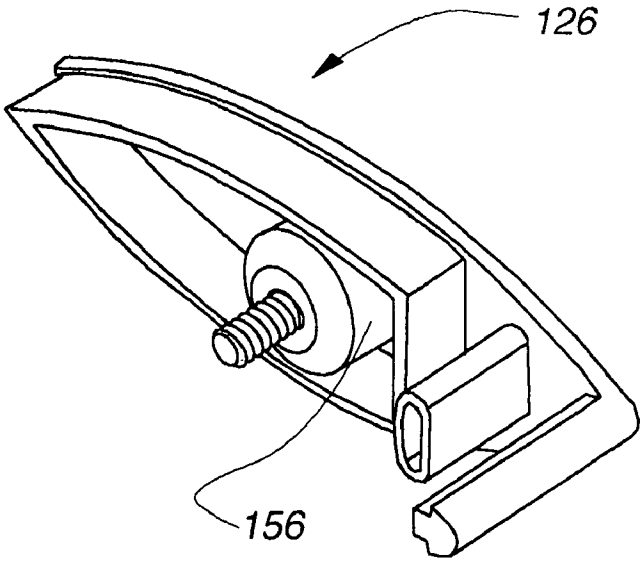
FIG. 18 is an isometric of an assembled end cap of the embodiment shown in FIG. 13.
Figure 20:
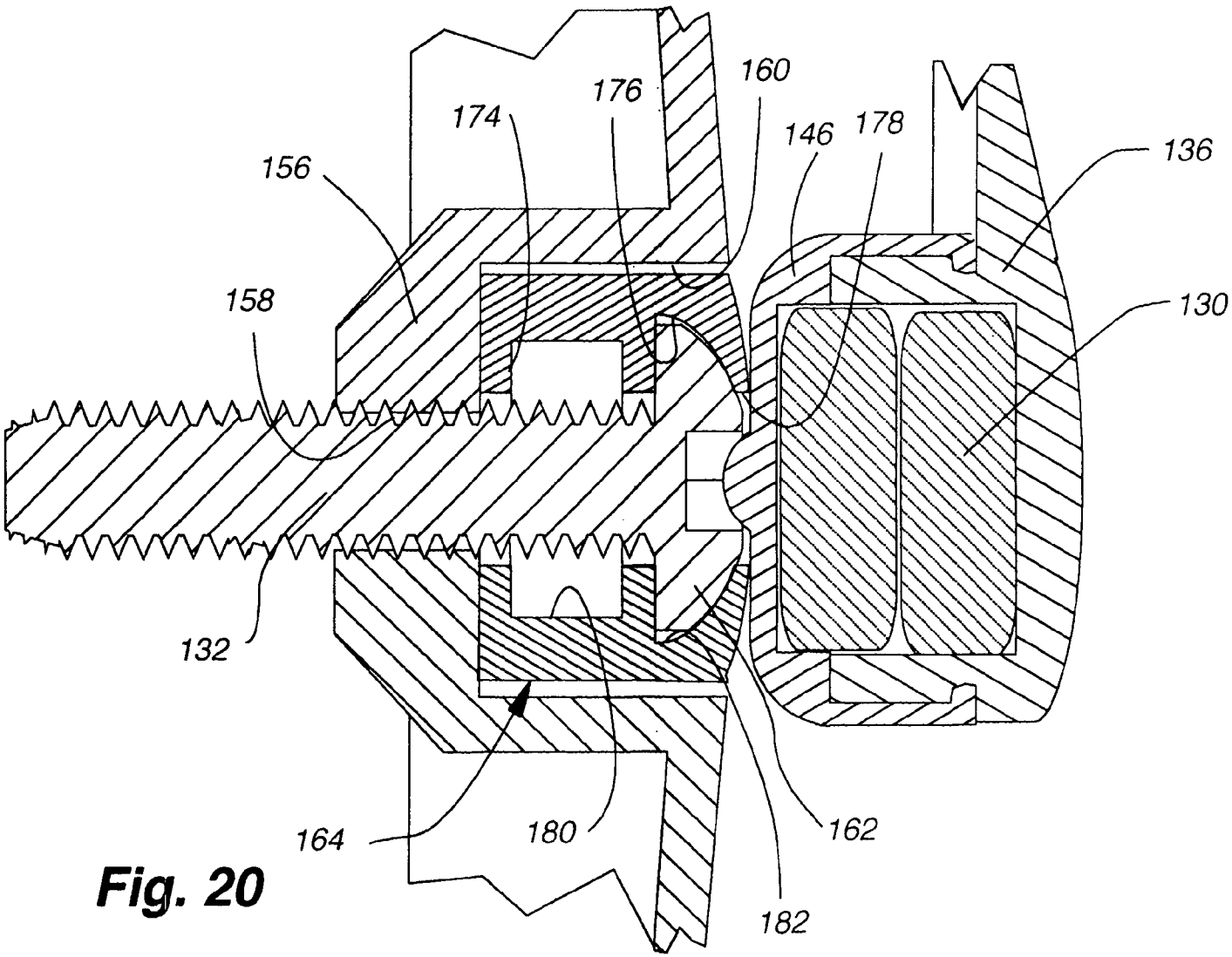
FIG. 20 is an enlarged fragmentary section taken along line 20—20 of FIG. 13.
Figure 21:
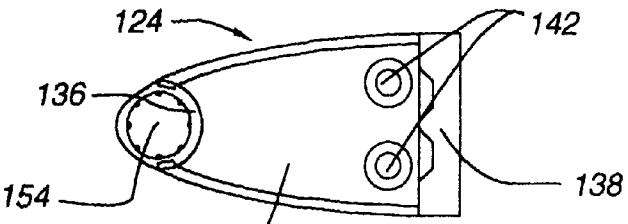
FIG. 21 is a front elevation of the catch bracket of FIG. 15.
Figure 22:
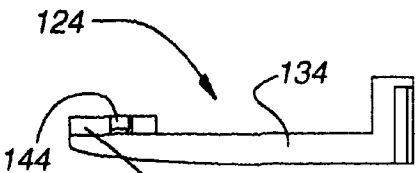
FIG. 22 is a side elevation of the catch bracket of FIG. 21.
Figure 23:
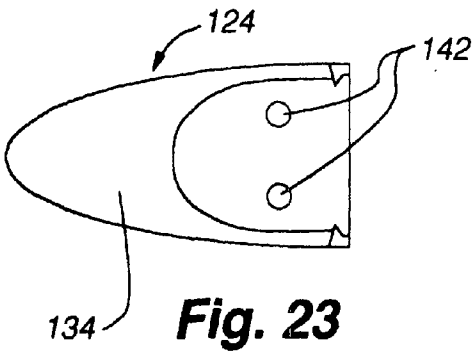
FIG. 23 is a rear elevation of the catch bracket of FIG. 21.
Figure 24:
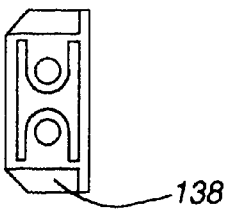
FIG. 24 is an end elevation of the catch bracket of FIG. 23.
Figure 25:
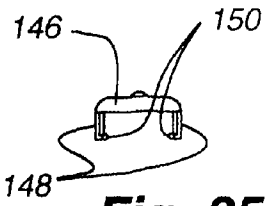
FIG. 25 is a front side elevation of a closure cap for the magnetic of the catch bracket of FIG. 21.
Figure 27:
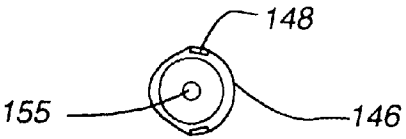
FIG. 27 is a bottom plan view of the closure cap of FIG. 25.
Figure 26:
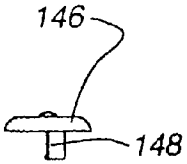
FIG. 26 is a side elevation of the closure cap of FIG. 25.
Figure 29:
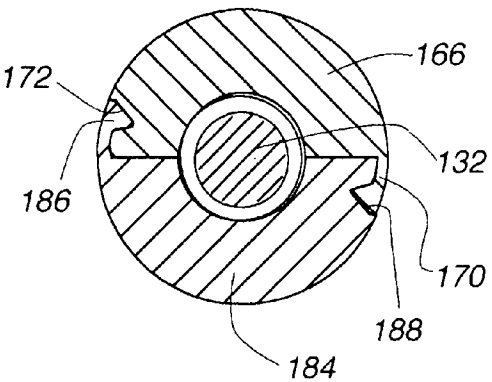
FIG. 29 is an enlarged section taken along line 29—29 of FIG. 32.

Referring next to FIGS. 18 and 19, the end cap 126 is very similar to the previously described end cap 100 in that it includes an extension wall 102 adapted to be inserted into an open end of a hollow bottom rail 66. The end cap also defines an end wall 104 to cover the end of the bottom rail with the end wall having an inner surface 106 having a cylindrical boss 156 integrally formed thereon with the boss having a circular threaded passage 158 therethrough and a cylindrical recess 160 opening through the end wall 104 as best seen in FIG. 20. As with the previously described end cap 100, the end cap 126 also has a rear plug 108 and a rear edge portion 110 extending from the inner surface 106 of the end cap. The cylindrical recess 160 in the boss is adapted to seat the metallic fastener 132 which is threadedly received in the passage 158 through the boss to hold it in position.

Figure 30:
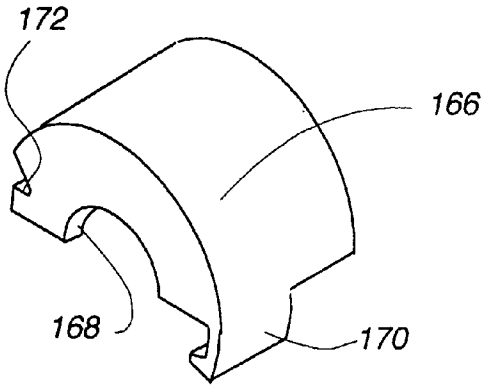
FIG. 30 is an isometric of half of a removal housing for the fastener used in the end cap of the embodiment of FIG. 13.
Figure 31:
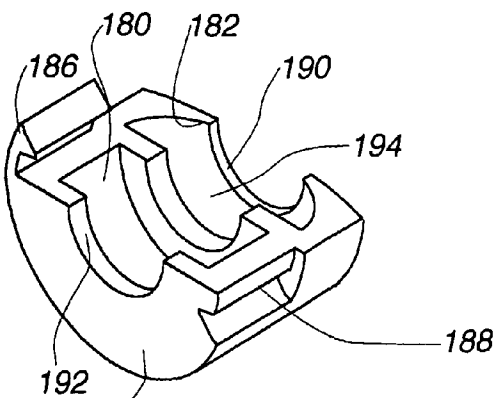
FIG. 31 is an isometric of the other half of the housing for the fastener of the end cap of FIG. 13.

The fastener 132 is best shown in FIG. 20 to comprise a threaded bolt having a crowned head 162 which is confined within a two-piece housing 164 shown best in FIGS. 28–33. A first half 166 of the housing, as seen in FIG. 30, is generally semi-cylindrical in configuration having a semi-circular passage 168 through an end wall, a catch arm 170 extending downwardly off one side, and a catch groove 172 formed in the opposite side. The interior of the first half of the housing has a semi-cylindrical recess 174 (FIG. 20) in axial alignment with a second recess 176 which communicates with a semi-circular opening 178 through the opposite end wall. The recesses are identical to similar recesses 180 and 182, respectively, shown in the second half 184 of the housing shown in FIG. 31.

The second half 184 of the housing 164 is also generally semi-cylindrical in configuration having the semi-cylindrical recess 180 and the second axially aligned recess 182 formed therein. A catch arm 186 and a catch groove 188 in opposite sides are also on the second half which are positioned to releasably cooperate with the catch groove 172 and the catch arm 170, respectively, on the first half 166 of the housing. In other words, when the housing components 166 and 184 are placed in confronting face-to-face relationship so as to form a complete cylinder, the catch arm 186 on the second half releasably engages the catch groove 172 on the first half and the catch arm 170 on the first half releasably engages the catch groove 188 in the second half. Similar to the first half, the second half of the housing has semi-circular passages 190 and 192 through opposite end walls which are axially aligned.

Figure 28:
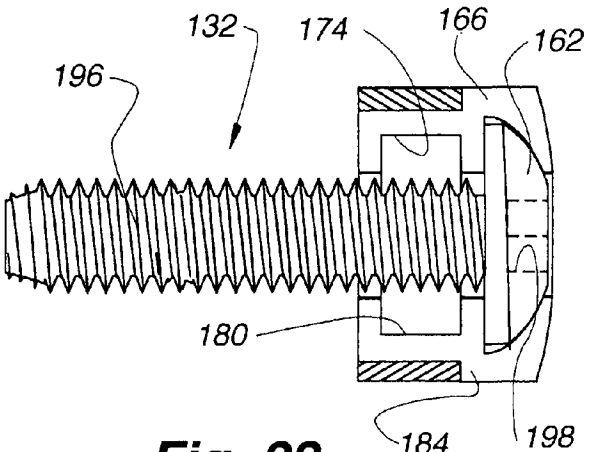
FIG. 28 is an enlarged section taken along line 28—28 of FIG. 32.
Figure 33:
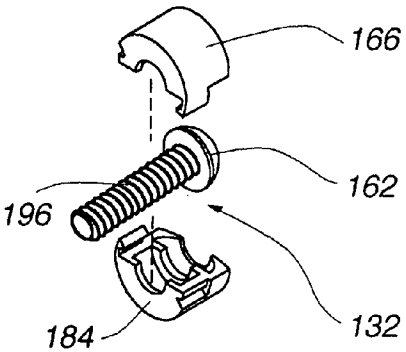
FIG. 33 is an exploded isometric of the fastener and housing shown in FIG. 32.
Figure 32:
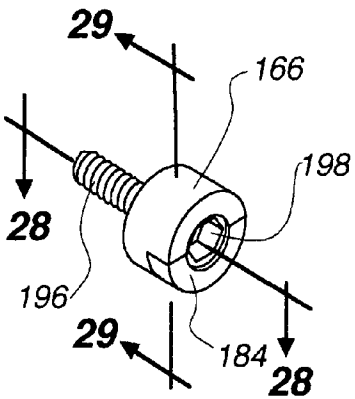
FIG. 32 is an isometric of the fastener used in the end cap of FIG. 13 with the housing component secured thereon.

The second recesses 176 and 182 in the first and second housing components have a curved surface 194 which conforms with the crowned head 162 of the fastener so that when the housing components are secured together, the head of the fastener is seated in the cavity formed by the confronting second recesses as shown in FIG. 28. Accordingly, when the housing is snapped in place around the head 162 of the fastener, the distal end of the threaded shank 196 of the fastener is positioned to be threadedly received in the boss 156 of the end cap 126 and the fastener can be advanced into the boss until the housing 164 is fully received within the cylindrical recess 160 in the outer wall of the boss.

Preferably the fastener is rotatable with an Allen wrench so that it has a hexagonal recess 198 in its head. The hexagonal recess opens through the opening in the outer end of the housing and can thereby releasably receive the pimple 155 on the closure cap of the catch bracket. This provides a releasable mechanical interlock between the catch bracket and the end cap which helps to center and retain the magnetic attraction between the magnet and the metallic fastener at a predetermined position.

The present invention can also be applied to other styles of blind assemblies and covers for architectural openings, and should not be construed to be limited to the embodiments described specifically herein. For example, the present invention is also applicable to blinds having solid slats or vanes or no vanes at all or to blinds having bottom rails that are not necessarily hollow. In addition, the present invention would be applicable to vertical blind arrangements such that a side rail in the vertical blind could be releasably retained adjacent to a side frame member of the architectural opening.

Although various embodiments of this invention have been described above with a certain degree of particularity or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments, and not limiting. Changes in detail or structure may be made without departing from the basic elements of the invention as defined in the following claims.

What is claimed is:

1. A combination of a covering for an architectural opening and a framework comprising in combination: a framework extending at least partially around said architectural opening; a retractable covering adapted to extend across said opening or be retracted adjacent to one side of said opening, said covering including a rail along a side edge thereof adapted to be positioned adjacent to a side of said opening opposite said one side of said opening when the covering is extended; and an adjustable system for attracting said rail to said opposite side of said opening, said adjustable system including a first magnetic component secured to said framework at a predetermined position adjacent to said opposite side of said opening and a second magnetic component positionable adjacent to said first mentioned magnetic component on said rail such that the magnetic components will attract each other to releasably retain said rail adjacent to said magnetic component in the framework, and an adjustable element for adjusting the spacing between said first and second magnetic components.

2. The combination of claim 1 wherein the magnetic component in one of said framework and rail is a magnet and the magnetic component in the other of said framework and rail is a metallic object.

3. The combination of claim 1 wherein the magnetic component in both of said framework and rail is a magnet.

4. The combination of claim 2 or 3 wherein said magnet is a ceramic, iron, or steel magnet.

5. The combination of claim 1 wherein said second magnetic component in the rail is embedded within the rail.

6. The combination of claim 5 wherein said rail has opposite ends positionable adjacent to said framework and there is a second magnetic component in each end of the rail.

7. The combination of claim 6 wherein said rail is hollow and further including end caps positioned in its opposite ends and wherein said second magnetic components are embedded in said end caps.

8. The combination of claim 1 or 6 further including a pair of brackets secured to said framework and wherein said magnetic components secured to said framework are secured to said brackets.

9. The combination of claim 8 wherein said framework has sides and said brackets are secured to said sides of the framework.

10. A combination of a covering for an architectural opening and a framework comprising in combination:

a framework extending at least partially around said architectural opening;

a magnetic component secured to said framework at a predetermined location, and a retractable covering adapted to extend across said opening or be retracted adjacent to one side of said opening, said covering including a rail along a side edge thereof adapted to be positioned adjacent to a side of said opening opposite said one side of said opening when the covering is extended, said rail having a second magnetic component positionable adjacent to said first-mentioned magnetic component on said framework such that the magnetic components will attract each other to releasably retain said rail adjacent to said magnetic component in the framework, said rail having opposite ends positionable adjacent to said framework and wherein there are two of said second magnetic components embedded one in each end of the rail with the rail being hollow and further including end caps positioned in its opposite ends with the second magnetic components being embedded in said end caps and wherein the magnetic components are metallic fasteners threadedly received in said end caps.

11. The combination of claim 10 further including a bracket on said framework in which said first-mentioned magnet component is mounted and wherein said fastener has a head positionable adjacent to said bracket and further including a housing at least partially surrounding said head.

12. The combination of claim 11 wherein said first-mentioned magnetic component is confined in a cavity having a closure cap with a pimple thereon and said fastener head has a recess in which said pimple can be releasably seated.

* * * * *